US010072234B2

(12) United States Patent
Behan et al.

(10) Patent No.: US 10,072,234 B2
(45) Date of Patent: Sep. 11, 2018

(54) FRAGRANCE COMPOSITIONS

(71) Applicant: Givaudan S.A., Vernier (CH)

(72) Inventors: John Martin Behan, Kent (GB); Briony Care, Kent (GB); Anne Churchill, Kent (GB); Michael Gordon Evans, Kent (GB); Keith Douglas Perring, Kent (GB); Alan Forbes Provan, Kent (GB)

(73) Assignee: Givaudan S.A., Vernier (CH)

( * ) Notice: Subject to any disclaimer, the term of this patent is extended or adjusted under 35 U.S.C. 154(b) by 0 days.

(21) Appl. No.: 14/095,477

(22) Filed: Dec. 3, 2013

(65) Prior Publication Data

US 2014/0194338 A1 Jul. 10, 2014

Related U.S. Application Data

(60) Continuation of application No. 12/986,687, filed on Jan. 7, 2011, now abandoned, which is a division of application No. 11/604,256, filed on Nov. 27, 2006, now abandoned.

(30) Foreign Application Priority Data

Oct. 23, 2006 (GB) ..... 0621023.1

(51) Int. Cl.
*C11B 9/02* (2006.01)
*C11B 9/00* (2006.01)

(52) U.S. Cl.
CPC *C11B 9/02* (2013.01); *C11B 9/00* (2013.01); *C11B 9/008* (2013.01); *C11B 9/0015* (2013.01); *C11B 9/0019* (2013.01); *C11B 9/0034* (2013.01); *C11B 9/0061* (2013.01); *C11B 9/0069* (2013.01); *C11B 9/0073* (2013.01); *C11B 9/0092* (2013.01)

(58) Field of Classification Search
CPC ..... C11B 9/00; C11B 9/0061
USPC ..... 512/1
See application file for complete search history.

(56) References Cited

U.S. PATENT DOCUMENTS

| | | | |
|---|---|---|---|
| 3,560,571 | A | 2/1971 | Kropp et al. |
| 4,278,658 | A | 7/1981 | Hooper et al. |
| 6,252,120 | B1 | 6/2001 | Dilk et al. |
| 7,097,863 | B2 | 8/2006 | Warrenburg et al. |
| 2004/0063604 | A1 | 4/2004 | Behan et al. |

FOREIGN PATENT DOCUMENTS

| | | | |
|---|---|---|---|
| EP | 1343466 | B1 | 1/2007 |
| JP | 2002-255774 | | 9/2002 |
| JP | 2005-187431 | | 7/2005 |
| WO | WO 01/24807 | A2 | 4/2001 |
| WO | WO 02/49600 | A1 | 6/2002 |
| WO | WO 2004/009750 | A1 | 1/2004 |
| WO | WO 2006/136828 | A1 | 12/2006 |

*Primary Examiner* — Peter F Godenschwager
(74) *Attorney, Agent, or Firm* — Morgan, Lewis & Bovkiud LLP

(57) ABSTRACT

A fragrance composition and use thereof by inhalation to promote activated, pleasant moods. The fragrance composition comprises at least 75% by weight of perfume materials including at least 10% by weight of at least three specific materials from a group identified as Group IMP and optionally up to 90% of specific materials selected from groups identified as HMR, HMI, HMP, RMP and GEN, the amounts of materials from said Groups falling within specified relationships.

18 Claims, 1 Drawing Sheet

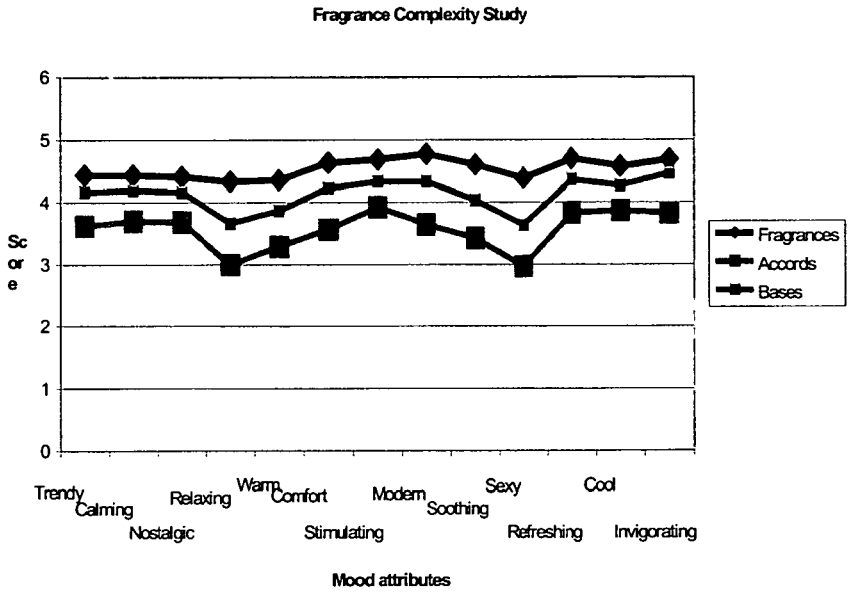
Fragrance Complexity Study
6
5
4
3
2
1
0
Score
Fragrances
Accords
Bases
Trendy
Calming
Nostalgic
Relaxing
Warm
Comfort
Stimulating
Modern
Soothing
Sexy
Refreshing
Cool
Invigorating
Mood attributes

FRAGRANCE COMPOSITIONS

FIELD OF THE INVENTION

The present invention relates to novel fragrance compositions and to consumer products that incorporate such fragrances.

BACKGROUND

The senses provide us with basic information about our surroundings. At a first level, sensory information can be broken down into its constituent parts each of which, in turn, can be perceived as being somewhere above a threshold level. For smell we can deconstruct perfume into different characteristics and perceive the relative preponderance of each. For odour, the key 'dimensions' of the sensory world are: threshold, intensity and character. In this way we can derive a quantitative or semi-quantitative descriptive analysis of a smell. However odours are also powerful drivers of mood and emotion and in many cases our primary response to odours is emotional.

Olfactory information feeds directly through the olfactory bulb into the limbic system, the emotional heart of the brain. This finding reinforces the conclusion that odour has a powerful ability to evoke emotions. Other senses confer sensory information on a far more factual level. The primacy of vision emphasises this.

Vision provides a sophisticated ability to resolve colour, shape, size, distance, movement, direction, texture; it informs recognition. It can be enjoyed at an artistic or abstract level through introspection but the first experience is factual, sensory information. The higher-level perceptions follow.

For odour, the process is generally reversed. Odour recognition in untrained subjects is low. Memory for odours is poor, certainly less than memory for words and pictures. The primary reactions to odour are hedonic, associative, and emotional. Once these responses bring an odour to the attention of the subject it may be further characterised, for example, with respect to its sensory dimensions.

Emotions (such as joy) are transitory, brief events. An episode will rarely last more than a minute.

Moods (such as happiness) can last much longer, even hours. They are background states which provide a context for emotions.

Moods can be both enablers and barriers. If the subject is in a happy mood then it is easier for them to experience joy. Conversely if the subject is in a sad mood it is more difficult for them to feel joy. They are inputting into our feelings of well-being, which in turn can be seen as the integration of emotional and physical inputs that come together to define the organism's state.

Our moods reset the baseline for feeling emotions. Moods and emotions may act as motivators encouraging us to act in ways that increase our survival chances and enjoyment. The structure of moods has been described by Russell (1980) and E Diener & R J Larsen (1984) who were able to classify the spectrum of emotions in terms of their pleasantness and the degree of activation involved. The circumplex model (see L. Feldman Barrett and J. A. Russell, 1999, Current Directions in Psychological Science, 8, p. 11 (American Psychological Society)) describes affect in terms of the two orthogonal dimensions of valence and activation. Activated, pleasant moods included states of invigoration and stimulation. Deactivated pleasant moods included Relaxed. Negative activated moods could be typified by Annoyed or Nervous, while negative deactivated moods could be exemplified by Boredom. The key dimensions of mood would be Stimulated-Calm and Happy-Sad. We have found that fragrances can enhance moods, and we describe here how fragrances can be specifically formulated to enhance activated, pleasant moods.

Context can have an influence on the moods evoked by odours and this is particularly relevant for positive, activated smells. This has largely been driven by associations with the usage of different fragrance classes in different consumer product applications, such as lemon in dish wash products. It is a phenomenon akin to that found in taste when a yellow drink delivers an expectation of 'lemon-ness'. The colour primes the taste and odour expectation.

The present invention is limited to the intrinsic mood effects of odours, and does not address those that may arise from additional external information which may be present in consumer products, and which will have an additional priming effect, for example, as in aromatherapy. Aromatherapy teaches that essential oils can provide stimulating effects. In its traditional form, an aromatherapist applies oils to the patients skin with massage to deliver benefits including mood. Occasionally aromatherapists will mix oils to achieve the desired effects. The use of aromatic plants and oils dates back to ancient times. Holy perfumes were used as incense or aromatic oil to evoke a spiritual atmosphere or heighten spiritual awareness. In the times of the Assyrians and the Babylonians aromatic oils were popular in spas and baths. These people believed that they could use fragrant essences to preserve their health and thus live longer. Traditionally the art of aromatherapy is concerned with healing. It has been shown more recently that essential oils are absorbed through the mucosas of the mouth, nose, pharynx, gastro-intestines and also through intact skin. The oils interact with certain cell membrane lipids thus causing, among other effects, an alteration of the calcium-ion-channel-function. Besides this direct molecular action there is also stimulation in the limbic system in the brain which is responsible for all our emotions and sensations such as anxiety, fear, feelings of wellness, harmony and sexual desires. Through this mode of action aromatherapy has several therapeutic benefits, for beauty, general well-being, emotional help and certain illnesses. Treatments may be used as an effective method of stress relief or they may help people to become more energised.

Although these practices benefit from the aroma of the materials used, it is not clear that the primary benefits arise from the aromas themselves or for example, the skin contact, the massage, the expectations of the subject, and/or the teachings of the aromatherapist. There is little consistency between the odours of essential oils, reputed to have stimulating effects.

Our research has shown that the ability of odours to enhance mood is related to their complexity. Complex odours in a similar olfactory category were generally more effective than simple blends, and simple blends were more effective than single materials and oils. In experiments, which involved pure smelling, as opposed to skin application and massage, the more complex creations outperformed their simple analogues in terms of mood generation. In all cases, perfumes developed according to the skills of the art, outperformed the simpler aromatherapy oils (see Example section).

Apart from the widespread usage of aromatherapy there are few disclosures in the literature that reveal how to design complex fragrances to deliver target emotional benefits. European patent number EP 1,343,466 describes perfumes that will aid relaxation and calming, and co-pending application PCT/GB2006/002285 describes how to formulate enlivening perfumes using a relatively limited perfume ingredient palette. U.S. Pat. No. 7,097,863 discloses a process for relaxing the back, shoulder or neck muscles through the inhalation of aroma notes described as rosy, floral, musky, ambery, sweet and/or powdery. EP 1,218,023 relates to fragranced personal care compositions that may be used to calm mammals, including humans and in particular, humans aged between about 1 day to 12 years. These compositions include sensory components comprising a specified essential oil together with particular perfume ingredients.

The sensory interactions of perfume ingredients are well known by those in the art to be very complex, and many years of training are required before perfumers become competent to work well with a wide repertoire of ingredients. Similar comments apply to the mood effects delivered by perfumes, but surprisingly it is possible to formulate perfumes with desirable emotional benefits using the creative rules described below.

REFERENCES

Diener, E. & Larsen, R. J. (1984). *Temporal stability and cross-situational consistency of affective, behavioural, and cognitive responses*, Journal of Personality and Social Psychology, 47, pages 871-883.

Russell, J. A. (1980). *A circumplex model of affect*. Journal of Personality and Social Psychology, 39, pages 1161-1178.

SUMMARY OF THE INVENTION

According to the present invention there is provided a method of promoting activated, pleasant moods through the inhalation of an effective amount of energising, non-stressing fragrances (invigorating fragrances). Also provided are the fragrance compositions themselves, together with consumer products that incorporate such fragrances to deliver the desired emotional benefits.

Fragrance compositions of this invention are comprised of at least 75% by weight, preferably 85% by weight of perfume materials drawn from the following groups:

A) At least 10% by weight in total of at least three materials drawn from Group 'IMP' comprising: allyl amyl glycolate; benzyl salicylate; bergamot oil; coriander oil; cyclamen aldehyde; 1-(2,6,10-trimethylcyclododeca-2,5,9-trien-1-yl)ethanone; prop-2-enyl (cyclohexyloxy)acetate; Damascenia 185 SAE; 2,4-dimethylheptan-1-ol; fir balsam; fir needle oil; 3-(4-ethylphenyl)-2,2-dimethylpropanal; ginger oil; guaiacwood; linalyl acetate; litsea cubeba oil; methyl 2,4-dihydroxy-3,6-dimethylbenzoate; nutmeg oil; olibanum oil; orange flower oil; Ozonal AB 7203C; patchouli oil; rose oxide; rosemary oil; sage clary oil; spearmint oil; Tamarine AB 8212E; tarragon oil;

B) Optionally up to 90% of materials from the following groups:

Group 'HMR' Comprising:

allyl ionone; benzyl acetate; cis-jasmone; citronellol; ethyl linalol; ethylene brassylate; 4-methyl-2-(2-methylpropyl)tetrahydro-2H-pyran-4-ol; geraniol; geranium oil; isoeugenol; lemon oil; 3-(4-hydroxy-4-methylpentyl)cyclohex-3-ene-1-carbaldehyde; 4-(4-hydroxy-4-methylpentyl) cyclohex-3-ene-1-carbaldehyde; alpha-iso-methyl ionone; 3-methylcyclopentadec-2-en-1-one; cyclopentadecanone; cyclohexadecanolide; gamma-undecalactone.

Group 'HMI' Comprising:

1-{[2-(1,1-dimethylethyl)cyclohexyl]oxy}butan-2-ol; 3a,6,6,9a-tetramethyldodecahydronaphtho[2,1-{b}]furan; alpha-damascone; dihydromyrcenol; eugenol; 3-(1,3-benzodioxol-5-yl)-2-methylpropanal; 2,4-dimethylcyclohex-3-ene-1-carbaldehyde; mandarin oil; orange oil; 2-(1,1-dimethylethyl)cyclohexyl acetate.

Group 'HMP' Comprising:

1-(2,6,6,8-tetramethyltricyclo[5.3.1.0 {1,5}]undec-8-en-9-yl)ethanone; allyl cyclohexylpropionate; allyl heptanoate; Apple Oliffac S pcmf; 7-methyl-2H-1,5-benzodioxepin-3(4H)-one; cassis base; cis-3-hexenyl salicylate; damascenone; gamma-decalactone; ethyl acetoacetate; ethyl maltol; ethyl methyl phenylglycidate; hexyl acetate; (3E)-4-methyldec-3-en-5-ol; 2,5,5-trimethyl-6,6-bis(methyloxy) hex-2-ene; 4-(4-hydroxyphenyl)butan-2-one; styrallyl acetate; 2,2,5-trimethyl-5-pentylcyclopentanone; ylang oil.

Group 'RMP' Comprising:

anisic aldehyde; (2Z)-2-ethyl-4-(2,2,3-trimethylcyclopent-3-en-1-yl)but-2-en-1-ol; benzoin siam resinoid; ethyl vanillin; oxacyclohexadec-12(13)-en-2-one; hexyl salicylate; hydroxycitronellal; jasmin oil; 3-methyl-5-phenylpentan-1-ol; 2-(phenyloxy)ethyl 2-methylpropanoate; alpha-terpineol; vanillin;

Group 'GEN' Comprising:

cyclopentadecanolide; hexyl cinnamic aldehyde; ionone beta; isobornyl cyclohexanol; 1-(2,3,8,8-tetramethyl-1,2,3,4,5,6,7(8),8(8a)-octahydronaphthalen-2-yl)ethanone; 3-[4-(1,1-dimethylethyl)phenyl]-2-methylpropanal; linalol; methyl dihydrojasmonate; 2-phenylethanol; provided the following conditions are met:

(a) IMPs>=HMPs+HMRs (b) IMPs+HMIs+GENs>=70%

(c) (IMPs+HMIs)/(IMPs+HMIs+RMPs+HMRs)>=0.7

(d) IMPs/(HMPs+RMPs+IMPs)>=0.5

(e) IMPs/[(HMPs+RMPs+IMPs)+(100−TOTAL)]>=0.3 wherein 'IMPs' indicates the sum of the percentages of materials within Group IMP, and similarly for the remaining groups, the symbol '>=' indicates 'at least equal to', and 'TOTAL' is the sum of HMPs, HMRs, HMIs, IMPs, RMPs and GENs, provided also that low odour or no odour solvents are excluded from the calculation of these sums.

References herein the percentage by weight of perfume ingredients means relative to the total weight of perfume ingredients in the perfume composition and excludes, for example, any optional solvents, diluents, etc.

Disclosed herein are perfume formulation rules that those skilled in the art of perfumery can use to create perfumes with a high probability of promoting activated mood states associated with feelings of invigoration and energisation.

We have carried out extensive studies into the relationship between perfume formulations and the mood states engendered upon inhalation of the perfumes. A variety of techniques have been used such as brain activity mapping, visual mood profiling and biophysical monitoring. Typical methodologies and output are described below.

The way in which a complex mixture of perfume ingredients affect mood is not well understood. Perfume materials that are associated with a mood state such as relaxing may nevertheless be useful in fragrance formulations that deliver the opposite affect. This ambiguity varies from material to material, and must be taken into account when creating fragrances designed for specific moods.

Without being bound by theory, on the basis of our observations we have classified perfume ingredients as belonging to various mood classes. This has enabled a number of predictive perfume creation rules to be constructed that are very useful in practice. The rules are based on recognising that membership of a class may be 'fuzzy', for example certain materials may be useful as building materials for a 'happy' fragrance but equally well may be useful in other perfume formulations to support say, relaxing moods or invigorating moods. Certain materials have been found to be useable in a fragrance (at the levels specified herein) to support a variety of mood states.

The classes are identified as follows: 'HMP' comprising perfume ingredients strongly associated with happy moods; 'HMR' comprising ingredients that may support both happy and relaxing moods; 'HMI' comprising ingredients that may support both happy and invigorating moods; 'RMP' comprising ingredients that strongly support relaxing moods; 'IMP' comprising ingredients that strongly support invigorating moods; and 'GEN; comprising ingredients that may support a variety of moods. It must be emphasized that these designations are relevant to ingredients as used by one skilled in the art (eg a perfumer) under the dosage and pattern constraints disclosed here.

Materials

The below list details the materials of the invention, giving the common name of each material as used within the perfume industry, alongside with (where possible or where relevant) the corresponding IUPAC name and/or tradename(s) and suppliers. Certain materials (e.g. mandarin oil) are complex mixtures whose exact compositions may vary with geography and season. In such cases here the invention is taken to refer to the general class of oils irrespective of origin.

Group IMP:

allyl amyl glycolate also known as prop-2-enyl[(2-methylbutyl)oxy]acetate;
benzyl salicylate also known as phenylmethyl 2-hydroxybenzoate;
bergamot oil;
coriander oil;
cyclamen aldehyde also known as 2-methyl-3-[4-(1-methylethyl)phenyl]propanal; 1-(2,6,10-trimethylcyclododeca-2,5,9-trien-1-yl)ethanone available under the name Cyclisone™ (Q);
Prop-2-enyl (cyclohexyloxy)acetate also known as allyl (cyclohexyloxy)acetate and cyclogalbanate;
Damascenia 185 SAE™ (F);
2,4-dimethylheptan-1-ol also known as dimethyl heptanol;
fir balsam;
fir needle oil;
3-(4-ethylphenyl)-2,2-dimethylpropanal available under the name Floralozone™ (IFF);
ginger oil;
guaiacwood;
linalyl acetate also known as 1-ethenyl-1,5-dimethylhex-4-enyl acetate;
litsea cubeba oil;
methyl 2,4-dihydroxy-3,6-dimethylbenzoate; also known as Moss Oakmoss Synthetic; nutmeg oil;
olibanum oil also known as olibanum resinoid;
orange flower oil;
Ozonal AB 7203C™ (Q);
patchouli oil;
rose oxide also known as 4-methyl-2-(2-methylprop-1-enyl) tetrahydro-2H-pyran (including racemic and chiral forms);
rosemary oil;
sage clary oil;
spearmint oil;
tamarine AB 8212E™;
tarragon oil.

Group HMP:

1-(2,6,6,8-tetramethyltricyclo[5.3.1.0{1,5}]undec-8-en-9-yl) ethanone, available under the names: Acetyl Cedrene, Vertofix Coeur™ (IFF), and Methyl Cedryl Ketone;
allyl cyclohexyl propionate also known as prop-2-enyl 3-cyclohexylpropanoate;
allyl heptanoate also known as prop-2-enyl heptanoate;
Apple Oliffac S Pcmf™ (IFF);
7-methyl-2H-1,5-benzodioxepin-3(4H)-one available under the name Calone 1951™ (CAL);
Cassis base;
cis-3-hexenyl salicylate also known as (3Z)-hex-3-enyl 2-hydroxybenzoate;
damascenone also known as (2E)-1-(2,6,6-trimethylcyclohexa-1,3-dien-1-yl)but-2-en-1-one;
gamma-decalactone also known as decalactone gamma and 5-hexyldihydrofuran-2(3H)-one;
ethyl acetoacetate also known as ethyl 3-oxobutanoate;
ethyl maltol also known as 2-ethyl-3-hydroxy-4H-pyran-4-one;
ethyl methyl phenylglycidate also known as ethyl 3-methyl-3-phenyloxirane-2-carboxylate;
hexyl acetate;
(3E)-4-methyldec-3-en-5-ol available under the names Jadenol (Q) and Undecavertol (G); 2,5,5-trimethyl-6,6-bis (methyloxy)hex-2-ene available under the name Methyl Pamplemousse (G);
4-(4-hydroxyphenyl)butan-2-one also known as Raspberry Ketone or Rastone;
styrallyl acetate also known as 1-phenylethyl acetate;
2,2,5-trimethyl-5-pentylcyclopentanone available under the name Veloutone (F);
ylang oil also known as ylang ylang oil.

Group HMR:

Allyl ionone also known as (1E)-1-(2,6,6-trimethylcyclohex-2-en-1-yl)hepta-1,6-dien-3-one;
benzyl acetate also known as phenylmethyl acetate;
cis-jasmone also known as 3-methyl-2-[(2Z)-pent-2-enyl] cyclopent-2-en-1-one;
citronellol also known as 3,7-dimethyloct-6-en-1-ol;
ethyl linalol also known as (6Z)-3,7-dimethylnona-1,6-dien-3-ol; ethylene brassylate also known as 1,4-dioxacycloheptadecane-5,17-dione;
4-methyl-2-(2-methylpropyl)tetrahydro-2H-pyran-4-ol available under the names Florosa™ (Q) or Florol™ (F);
geraniol also known as (2E)-3,7-dimethylocta-2,6-dien-1-ol;
geranium oil;
iso eugenol also known as 2-(methyloxy)-4-[(1E)-prop-1-enyl]phenol;
lemon oil;
3-(4-hydroxy-4-methylpentyl)cyclohex-3-ene-1-carbaldehyde and 4-(4-hydroxy-4-methylpentyl)cyclohex-3-ene-1-carbaldehyde and mixtures thereof (eg as available under the name Lyral™ (IFF));
alpha-iso-methyl ionone also known as methyl ionone alpha iso and (3E)-3-methyl-4-(2,6,6-trimethylcyclohex-2-en-1-yl)but-3-en-2-one;
3-methylcyclopentadec-2-en-1-one available under the name Muscenone™ (F);
cyclohexadecanolide and cyclopentadecanone and mixtures thereof, e.g. as available under the name Silvanone™ (Q);
gamma-undecalactone also known as 5-heptyldihydrofuran-2(3H)-one, and Peche Pure™ (G).

Group HMI:

1-{[2-(1,1-dimethylethyl)cyclohexyl]oxy}butan-2-ol available under the name Amber Core™ (Q);

3a,6,6,9a-tetramethyldodecahydronaphtho[2,1-{b}]furan available under the names Amberlyn Super™ (Q) and Cetalox™ (F);

alpha-damascone also known as damascone alpha and (2E)-1-(2,6,6-trimethylcyclohex-2-en-1-yl)but-2-en-1-one;

dihydromyrcenol also known as 2,6-dimethyloct-7-en-2-ol;

eugenol also known as 2-(methyloxy)-4-prop-2-enylphenol;

3-(1,3-benzodioxol-5-yl)-2-methylpropanal available under the names Aquanal™ (Q) and Helional™ (IFF);

2,4,-dimethylcyclohex-3-ene-1-carbaldehyde also known as Ligustral™ (Q);

mandarin oil;

orange oil;

2-(1,1-dimethylethyl)cyclohexyl acetate available under the names Ortholate™ (Q) and Verdox™ (IFF);

Group RMP:

anisic aldehyde also known as 4-(methyloxy)benzaldehyde;

(2Z)-2-ethyl-4-(2,2,3-trimethylcyclopent-3-en-1-yl)but-2-en-1-ol available under the names Bangalol™ (Q) and Bacdanol™ (IFF);

Benzoin Siam resinoid;

ethyl vanillin also known as 3-(ethyloxy)-4-hydroxybenzaldehyde;

oxacyclohexadec-12(13)-en-2-one available under the name Habanolide™ (F);

hexyl salicylate also known as hexyl 2-hydroxybenzoate;

hydroxycitronellal also known as 7-hydroxy-3,7-dimethyloctanal;

jasmin oil;

3-methyl-5-phenylpentan-1-ol also known as Mefrosol™ (Q);

2-(phenyloxy)ethyl 2-methylpropanoate also known as phenoxyethyl isobutyrate and available as a major component in Prunella™ (F);

alpha-terpineol also known as terpineol or 2-(4-methylcyclohex-3-en-1-yl)propan-2-ol; vanillin also known as 4-hydroxy-3-(methyloxy)benzaldehyde.

Group GEN:

cyclopentadecanolide also known as oxacyclohexadecan-2-one;

hexyl cinnamic aldehyde also known as (2E)-2-hexyl-3-phenylprop-2-enal;

ionone beta also known as beta-ionone and (3E)-4-(2,6,6-trimethylcyclohex-1-en-1-yl)but-3-en-2-one;

isobornyl cyclohexanol also known as 3-(5,5,6-trimethylbicyclo[2.2.1]hept-2-yl)cyclohexanol and available under the name Sandela™ (G);

1-(2,3,8,8-tetramethyl-1,2,3,4,5,6,7(8),8(8a)-octahydronaphthalen-2-yl)ethanone available under the name Iso E Super™ and Isoambois™;

3-[4-(1,1-dimethylethyl)phenyl]-2-methylpropanal available under the name lily aldehyde; linalol also known as 3,7-dimethylocta-1,6-dien-3-ol;

methyl dihydrojasmonate also known as methyl (3-oxo-2-pentylcyclopentyl)acetate;

2-phenylethanol also known as phenyl ethyl alcohol or phenyl ethanol.

Key to Suppliers:

F=Firmenich
G=Givaudan
IFF=International Flavors and Fragrances
Q=Quest International
SYM=Symrise Solvents A number of liquids are commonly used within perfumery as solvents for difficult to dissolve, intractable compounds such as solids or gums, or as carriers for powerful materials with intense odours. Examples of such solvents include dipropylene glycol (DPG), diethyl phthalate (DEP), benzyl benzoate, isopropyl myristate (IPM), triacetin and triethyl citrate (TEC). Typically these materials have no or very low odour and make little contribution to the overall odour of a perfume when present at normal concentrations (less than 60%, usually less than 40%, often less than 20%). For the purposes of this invention, such vehicles are not included in the calculations of the percentage compositions, so that, for example a perfume mixture containing 50% w/w of DPG together with 10% each of five perfume materials would be considered to be a perfume with the five materials at 20% w/w each. This solvent correction is necessary to provide a true picture of the odour-bearing fraction of a perfume.

'No or very low odour' means that is scores less than 80 on an odour index scale as set out in EP0404470 (based on a comparison with the odour intensity of a control sample of a 10% solution of benzyl acetate in dipropylene glycol, which corresponds to an index of 100), and includes diethylphthelate, dipropylene glycol, triacetin, benzyl benzoate, triethyl citrate, Herculyn D (trade mark), isopropyl myristate and acetyl tributylcitrate.

Preferences

Preferred fragrance compositions comprise (following adjustment of the perfume composition allowing for solvents) at least 15% by weight of ingredients drawn from the Group IMP. Furthermore, the sum of the percentages of ingredients falling within Groups IMP, HMI, and GEN is preferably at least 80%. Preferably the ratio IMPs/(HMPs+RMPs+IMPs) is at least 0.6. Also preferred are perfumes that comprise at least five ingredients that are members of Group IMP, even more preferably at least eight ingredients. Generally perfumes of the invention will contain at least 15 perfumery ingredients (including those not classified herein, but excluding solvents), and it is preferred that they contain at least 25 ingredients, even more preferred 40 ingredients. For the purposes of calculating numbers of ingredients, materials present at less than 0.1% may be ignored, and essential oils are counted as single materials.

Most preferred are fragrance compositions comprising at least 25% by weight of ingredients drawn from the Group IMP. Furthermore, the sum of the percentages of ingredients falling within Groups IMP, HMI, and GEN is most preferably at least 90%. Most preferably the ratio IMPs/(HMPs+RMPs+IMPs) is at least 0.8.

The fragrance compositions of the invention exert a mood benefit via olfactory sampling of an effective amount of the perfume through inhalation. The inhalation may be of the headspace above the perfume itself, or above consumer products including the perfume, for example alcoholic systems such as colognes, bath and body preparations, air fresheners, and many others. The term 'headspace' as used here means the space surrounding a product, and this relates not only to the 'smell from the bottle' but also to that produced in use e.g. during showering. The term "effective amount" refers to the percentage by weight of the invigorating fragrance that is needed to be incorporated into a consumer product to promote the desired state of energisation.

In a further aspect, the invention provides a method of promoting a mood of well-being and happiness through the inhalation of an effective amount of at least one invigorating fragrance as described herein in an aesthetically pleasing form, such as, for example, cologne, an air freshener or a shampoo.

The fragrance compositions may be used "as is" (e.g., 100%) or in a "cologne". Directions for quantity to use and frequency of use, as well as variations in the formulation, e.g., summer and winter formulations, may be employed to assure that effective levels of invigorating fragrance(s) may be administered. For the purpose of this invention, the term "cologne", as exemplified hereinafter, means an invigorating fragrance incorporated in an alcoholic or hydroalcoholic solution. The invigorating fragrance can vary between 1 to 99% and the balance of the formulation is comprised of alcohol or a mixture of water and alcohol. The water:alcohol weight ratio can vary from 50:50 to 0:100. Examples of alcohols typically used in these products are SDA 39-C and SDA-40, either 190 "proof" or anhydrous (See "Ethyl Alcohol Handbook", 5th Edition, Published by National Distillers and Chemical Co.). The cologne can also contain solubilizing agents, emollients, humectants, thickening agents, bacteriostats or other cosmetically used ingredients.

Consumer Compositions

As used herein, "consumer composition" includes, but is not limited to, room fresheners or room deodorants; clothes deodorants; fabric softeners; dryer-added fabric softener articles; household cleansers; toilet bowl cleaners; cosmetic products such as powders, creams, deodorants, hand lotions and sun screens; personal care products such as antiperspirant and underarm deodorants, general body deodorants, hair care products such as hair sprays, conditioners, rinses, shampoos; foot care products; colognes, after shaves and body lotions; solid or liquid soaps and anionic, cationic, nonionic or zwitterionic detergents; odour control products; perfumed polymers; space odorants; colognes, toilet waters, hair preparations, such as lacquers, brilliantines, and pomades.

Consumer compositions may take a variety of forms including, but not limited to, powders such as talc, dusting powders, face powders and the like, bars, sticks, tablets, mousses, gels, liquids, sprays, fabric conditioning sheets, cleansing compositions, powders, oils, bath oils and other bath compositions, aerosols, candles, substances that may be used with vaporizers, wipes, washes, shampoos, gels, soaps, sticks, balms, sachets, pillows, mousses, sprays, lotions, creams and cleansing compositions.

When fragrance compositions are used as an olfactory component of a consumer composition, such as a solid or liquid anionic, cationic, nonionic or zwitterionic detergent or a cosmetic powder or a deodorant stick, as little as 0.1% by weight of the fragrance composition in the perfumed article will suffice. In space odorant applications, on the other hand, as much as 99% of the combined carrier perfume substance and fragrance composition(s) can be present. Thus, consumer compositions may contain in the range of from about 0.1% up to about 99% of a composition of matter consisting essentially of fragrance composition(s) of this invention.

The term "consumer composition" also includes solid-form polymers, such as polyethylene, polypropylene and other polymers that contain pores. Such perfumed polymers can be produced according to any technique well known to one having ordinary skill in the art.

The fragrance compositions may also further include other odoriferous components that may be used for purposes of improving the appeal to the consumer.

Dispensing

In yet another aspect of this invention, at least one fragrance composition is dispensed in an amount and time effective to provide a vaporous emission for inhalation.

Dispensing of the fragrance compositions may be by any conventional means, such as from a vessel containing the odorant substance, optionally with a valve and nozzle mechanism, an aerosol or non-aerosol spray, a gas, a solid or liquid air freshener, a scented cloth, lotion, cream, perfume, cologne, potpourri, incense, light bulb ring, a candle, fabric softener, carpet shampoo or freshener, a plug-in air freshener, and the like. The invigorating fragrances can be dispensed in combination with an odorless liquid carrier such as mineral oil or water, and can be formulated with a viscosity effective to allow for aerosolization.

The fragrance compositions may also be packaged as a part of an article of manufacture, or kit. The kit can include in association, for example, (a) a carrier and other optional additives for forming a composition, placed in containing means such as a vial, jar, pouch, can, bottle, cloth, aerosol can, blister pack, and the like, containing an effective amount of an invigorating fragrance; and (b) means for instructing as to the invigorating fragrance and its use to promote well-being and happiness. The parts of the kit can be contained or separately packaged within a packaging material, such as a box or bag.

The fragrance compositions can be delivered in the form of a liquid solution, aerosol spray, solid, microcapsules, or other suitable form to deliver a suprathreshold amount of the odorant for sniffing and inhalation into the nasal passageway. The fragrance compositions can be administered in combination with an odourless liquid carrier such as mineral oil or water, and can be formulated with a viscosity effective to allow for aerosolisation. The fragrance compositions can be dispensed, for example, by means of a cloth material that is coated with fragrance compositions, as a solid or liquid form contained in a capped vessel, from an aerosol or pump-type spray device, as a nasal spray, by opening a blister pack or scratch-and-sniff odour patch containing the odorant in the form of microspheres, from a pen-like dispenser containing a liquid form of the fragrance compositions adsorbed to a wicking material, and the like.

Delivery of the fragrance compositions may employ a device that is portable and minimally disruptive of bystanders. The invigorating fragrances can also be administered to a group of people within a confined area, for example, by pumping air containing invigorating fragrance through an air vent, spraying the invigorating fragrances into the air as a mist or dry powder using an aerosol or non-aerosol spray, and the like.

It is preferred that the fragrances of the invention be capable of prolonged mood enhancement (e.g. over hours) as opposed to an instantaneous effect. These effects can be monitored by measurement of salivary cortisol, and comparing the results with those from a "no odour" control. The body produces more cortisol as a reaction to stress, and the level of bodily cortisol is reflected in the level of cortisol in the saliva. Salivary cortisol provides a convenient route to assess the degree of stress over a period of hours.

EXAMPLES

The invention will be further described by reference to the following detailed examples, wherein the methodologies are as described below.

FIG. 1 is a graph of smelling score against a variety of mood attributes for fragrance compositions described as being either a base, an accord or a finished fragrance.

EXAMPLE 1

A Study on Perfume Complexity

A total of 20 different odours were evaluated in a consumer sniff test. The odours were grouped according to their complexity into 3 groups: complex finished fragrances, mixes of fragrance materials known as accords, and simple fragrance mixes or bases. The consumers were asked to smell a subset of the odours and score against the attributes: trendy, calming, nostalgic, relaxing, warm, comforting, stimulating, modern, soothing, sexy, refreshing, cool, energising. The results shown in FIG. 1 indicate that the more complex fragrances outperformed their simpler analogues across each of these attributes.

EXAMPLE 2

The fragrance compositions detailed in Table 1 were prepared and subjected to a variety of test protocols. Those fragranced labelled I1 through to I4 are fragrance compositions according to the invention, whereas those labelled C1 through C4 are comparatives. Analysis of these compositions according to the group classifications given here is shown below.

TABLE 1

Fragrance compositions

| | | FRAGRANCE COMPOSITIONS | | | | | | | |
|---|---|---|---|---|---|---|---|---|---|
| INGREDIENT | GROUP | I1 w/w % | I2 w/w % | I3 w/w % | I4 w/w % | C1 w/w % | C2 w/w % | C3 w/w % | C4 w/w % |
| ALLYL AMYL GLYCOLATE (Q) | IMP | 0.0 | 0.0 | 0.6 | 0.0 | 0.2 | 0.0 | 0.0 | 0.0 |
| ALLYL AMYL GLYCOLATE 10% DPG | IMP | 0.0 | 0.0 | 0.0 | 1.1 | 0.0 | 0.0 | 0.0 | 0.0 |
| ALLYL CYCLOHEXYLPROPIONATE | HMP | 0.0 | 0.0 | 0.0 | 0.0 | 0.0 | 0.0 | 0.0 | 0.0 |
| ALLYL HEPTANOATE | HMP | 0.0 | 0.0 | 0.0 | 0.0 | 0.0 | 0.0 | 0.0 | 0.0 |
| ALLYL IONONE (G) | HMR | 0.0 | 0.0 | 0.0 | 0.1 | 0.0 | 0.0 | 0.0 | 0.0 |
| AMBER CORE (TM) (Q) | HMI | 0.0 | 0.0 | 0.6 | 0.7 | 0.0 | 0.0 | 0.0 | 0.0 |
| AMBERLYN SUPER (TM) (Q) | HMI | 0.0 | 0.0 | 0.0 | 0.3 | 0.0 | 0.0 | 0.0 | 0.0 |
| AMBERLYN SUPER (TM) (Q) 10% DPG | HMI | 2.0 | 0.0 | 2.1 | 0.0 | 0.0 | 0.0 | 1.0 | 0.0 |
| AMBRETTOLIDE (TM) (G) | N/A | 0.0 | 0.0 | 0.0 | 0.0 | 0.0 | 0.0 | 0.0 | 0.0 |
| AMYL SALICYLATE | N/A | 0.0 | 0.0 | 0.0 | 0.0 | 0.0 | 0.0 | 1.0 | 2.0 |
| ANISIC ALDEHYDE | RMP | 0.0 | 0.0 | 0.0 | 0.0 | 0.0 | 0.0 | 0.0 | 0.0 |
| APPLE OLIFFAC S PCMF (TM)(IFF) | HMP | 0.0 | 0.0 | 0.0 | 0.0 | 0.0 | 0.0 | 0.4 | 0.0 |
| APPLINAL (TM)(Q) | N/A | 0.0 | 0.0 | 0.0 | 0.0 | 0.0 | 0.0 | 0.0 | 0.0 |
| ARMOISE TUNISIAN 10% DPG | N/A | 0.0 | 0.0 | 0.0 | 0.0 | 0.0 | 0.0 | 0.0 | 0.0 |
| ARMOISE TUNISIAN OIL | N/A | 0.0 | 0.0 | 0.5 | 0.0 | 0.0 | 0.0 | 0.0 | 0.0 |
| BANGALOL (TM)(Q) | RMP | 0.0 | 0.0 | 0.5 | 0.6 | 0.0 | 3.0 | 0.5 | 4.2 |
| BANGALOL LAEVO (TM)(Q) | RMP | 0.0 | 1.0 | 0.0 | 0.0 | 0.5 | 0.0 | 0.0 | 0.0 |
| BASIL COMORES OIL | N/A | 0.0 | 0.0 | 0.0 | 0.0 | 0.0 | 0.0 | 0.0 | 0.0 |
| BASIL COMORES OIL 10% DPG | N/A | 0.0 | 0.0 | 0.3 | 0.0 | 0.0 | 0.0 | 0.0 | 0.0 |
| BENZALDEHYDE 10% DPG | N/A | 0.0 | 0.0 | 0.0 | 0.0 | 0.0 | 0.0 | 0.1 | 0.0 |
| BENZOIN SIAM RESINOID 50% DPG | RMP | 0.0 | 0.0 | 0.0 | 0.0 | 0.0 | 4.0 | 0.0 | 2.0 |
| BENZYL ACETATE | HMR | 0.0 | 3.0 | 0.0 | 0.0 | 0.5 | 0.0 | 4.0 | 4.5 |
| BENZYL SALICYLATE | IMP | 0.0 | 0.0 | 7.0 | 0.0 | 0.0 | 0.0 | 0.0 | 0.0 |
| BERGAMOT OIL | IMP | 18.0 | 5.0 | 15.0 | 18.0 | 0.0 | 3.0 | 4.0 | 0.0 |
| BIRCH LEAF | N/A | 0.0 | 0.0 | 0.0 | 0.0 | 0.0 | 0.0 | 0.4 | 0.0 |
| CALONE 1951(TM) | HMP | 0.0 | 0.0 | 0.0 | 0.0 | 0.1 | 0.0 | 0.0 | 0.0 |
| CALONE 1951(TM) 1% DPG | HMP | 0.0 | 0.0 | 0.0 | 0.0 | 0.0 | 0.0 | 0.0 | 0.0 |
| CAMOMILE MOROCCAN OIL | N/A | 0.0 | 0.0 | 0.2 | 0.0 | 0.0 | 0.0 | 0.0 | 0.0 |
| CAMOMILE ROMAN 10% DPG | N/A | 0.0 | 0.0 | 0.0 | 0.0 | 0.0 | 0.0 | 0.0 | 0.0 |
| CARDAMOM OIL | N/A | 0.0 | 0.0 | 0.0 | 0.1 | 0.0 | 0.0 | 0.0 | 0.0 |
| CASSIONE (TM) 10% DPG | N/A | 0.0 | 0.0 | 0.0 | 0.0 | 0.0 | 0.0 | 0.0 | 0.0 |
| CASSIS BASE | HMP | 0.0 | 0.0 | 0.0 | 0.0 | 1.8 | 0.0 | 0.3 | 0.0 |
| CASSIS BASE 10% DPG | HMP | 0.0 | 0.0 | 2.0 | 0.0 | 0.0 | 0.0 | 0.0 | 0.0 |
| CEDARWOOD VIRGINIAN OIL | N/A | 0.0 | 0.0 | 0.0 | 0.0 | 0.0 | 0.0 | 0.0 | 0.0 |
| CEDRENYL ACETATE | N/A | 0.0 | 0.0 | 1.3 | 0.0 | 0.0 | 0.0 | 0.0 | 0.0 |
| CETALOX (TM) (F) 10% DEP | HMI | 0.0 | 0.0 | 0.0 | 0.0 | 0.0 | 0.0 | 0.0 | 0.0 |
| CETALOX (TM) (F) | HMI | 0.0 | 0.0 | 0.0 | 0.0 | 0.0 | 0.0 | 0.0 | 0.0 |
| CINNAMIC ALCOHOL | N/A | 0.0 | 0.0 | 0.0 | 0.0 | 0.0 | 0.0 | 0.0 | 2.4 |
| CINNAMON LEAF OIL | N/A | 0.0 | 0.0 | 0.0 | 0.0 | 0.0 | 0.0 | 0.0 | 0.0 |
| CIS 3 HEXENOL | N/A | 0.0 | 0.0 | 0.0 | 0.0 | 0.1 | 0.0 | 0.0 | 0.0 |
| CIS 3 HEXENOL 10% DPG | N/A | 0.0 | 0.0 | 0.0 | 1.0 | 0.0 | 2.0 | 1.0 | 0.0 |
| CIS 3 HEXENYL ACETATE 10% DPG | N/A | 0.0 | 0.0 | 0.0 | 0.0 | 0.0 | 0.0 | 1.0 | 0.0 |
| CIS 3 HEXENYL METHYL CARBONATE | N/A | 0.0 | 0.0 | 0.0 | 0.0 | 0.0 | 0.0 | 0.0 | 0.0 |
| CIS 3 HEXENYL METHYL CARBONATE 10% DPG | N/A | 0.0 | 0.0 | 0.0 | 0.8 | 0.0 | 0.0 | 0.0 | 0.0 |
| CIS 3 HEXENYL SALICYLATE | HMP | 3.0 | 5.0 | 0.0 | 0.0 | 2.0 | 0.0 | 2.5 | 0.0 |
| CIS JASMONE | HMR | 0.0 | 0.0 | 0.0 | 0.0 | 0.3 | 0.0 | 0.1 | 0.0 |
| CIS JASMONE 10% DPG | HMR | 0.0 | 0.0 | 0.0 | 0.6 | 0.0 | 0.0 | 0.0 | 0.0 |
| CIS-6-NONEN-1-OL 0.1% DPG | N/A | 0.0 | 0.0 | 0.0 | 0.0 | 0.5 | 0.0 | 0.0 | 0.0 |
| CITRONELLOL | HMR | 0.0 | 0.0 | 0.0 | 0.0 | 1.0 | 0.0 | 0.0 | 1 |
| CITRONELLYL ACETATE | N/A | 0.0 | 0.0 | 0.0 | 0.0 | 0.0 | 0.0 | 0.0 | 0.0 |
| CLOVE BUD OIL | N/A | 0.0 | 0.0 | 0.0 | 0.0 | 0.0 | 0.0 | 0.0 | 3 |
| CORIANDER OIL | IMP | 0.0 | 0.0 | 0.6 | 0.0 | 0.0 | 0.0 | 0.0 | 0.0 |

TABLE 1-continued

Fragrance compositions

| INGREDIENT | GROUP | FRAGRANCE COMPOSITIONS I1 w/w % | I2 w/w % | I3 w/w % | I4 w/w % | C1 w/w % | C2 w/w % | C3 w/w % | C4 w/w % |
|---|---|---|---|---|---|---|---|---|---|
| COUMARIN | N/A | 0.0 | 0.0 | 0.7 | 0.4 | 0.0 | 1.0 | 0.0 | 4 |
| CUMIN SEED 10% DPG | N/A | 0.0 | 0.0 | 0.7 | 0.0 | 0.0 | 0.0 | 0.0 | 0.0 |
| CYCLAMEN ALDEHYDE | IMP | 0.0 | 0.0 | 1.0 | 0.0 | 1.0 | 0.0 | 0.0 | 0.0 |
| CYCLISONE (TM) | IMP | 0.0 | 3.0 | 1.0 | 0.0 | 0.0 | 0.0 | 0.0 | 0.0 |
| CYCLO GALBANATE | IMP | 0.0 | 0.0 | 0.0 | 0.2 | 0.0 | 0.0 | 0.0 | 0.0 |
| CYCLOPENTADECANOLIDE | GEN | 0.0 | 0.0 | 0.0 | 2.0 | 0.0 | 0.0 | 1.5 | 1 |
| CYCLOGALBANATE 10% DPG | IMP | 0.0 | 0.0 | 0.0 | 0.0 | 0.8 | 0.0 | 0.0 | 0.0 |
| DAMASCENIA 185 SAE (F) (TM) | IMP | 0.0 | 0.0 | 0.0 | 0.0 | 0.0 | 0.0 | 0.1 | 0.0 |
| DAMASCENONE 10% DPG | HMP | 0.0 | 0.0 | 0.0 | 0.0 | 0.5 | 0.0 | 0.0 | 0.0 |
| DAMASCONE ALPHA 10% DPG | HMI | 0.0 | 0.0 | 0.3 | 0.0 | 0.0 | 0.0 | 0.8 | 0.0 |
| DECALACTONE GAMMA | HMP | 0.0 | 0.0 | 0.0 | 0.0 | 0.3 | 0.0 | 0.0 | 0.0 |
| DIHYDROJASMONE (Q) | N/A | 0.0 | 0.0 | 0.0 | 0.0 | 0.0 | 0.0 | 0.0 | 0.0 |
| DIHYDROMYRCENOL | HMI | 0.0 | 0.0 | 6.5 | 6.0 | 1.0 | 3.0 | 1.0 | 0.0 |
| DIMETHYL PHENYLETHYL CARBINOL | N/A | 0.0 | 0.0 | 0.0 | 0.0 | 0.0 | 0.0 | 0.0 | 0.0 |
| DIMETHYLHEPTANOL | IMP | 0.0 | 0.0 | 1.8 | 0.0 | 0.0 | 0.0 | 0.0 | 0.0 |
| DIPROPYLENE GLYCOL (DPG) | SOLV | 0.0 | 9.8 | 3.5 | 4.6 | 11.4 | 0.0 | 3.9 | 6.6 |
| ETHYL ACETOACETATE | HMP | 0.0 | 0.0 | 0.0 | 0.0 | 0.5 | 0.0 | 0.0 | 0.0 |
| ETHYL BUTYRATE 10% DPG | N/A | 0.0 | 0.0 | 0.0 | 0.0 | 0.0 | 0.0 | 0.0 | 0.0 |
| ETHYL LINALOL | HMR | 0.0 | 0.0 | 0.0 | 0.0 | 0.0 | 0.0 | 0.0 | 0.0 |
| ETHYL MALTOL | HMP | 0.0 | 0.0 | 0.0 | 0.0 | 0.0 | 0.0 | 0.0 | 0.0 |
| ETHYL MALTOL 1% DPG | HMP | 0.0 | 0.0 | 0.0 | 0.0 | 0.0 | 0.0 | 0.0 | 0.0 |
| ETHYL METHYL PHENYLGLYCIDATE | HMP | 0.0 | 0.0 | 0.0 | 0.0 | 0.0 | 0.0 | 0.0 | 0.0 |
| ETHYL VANILLIN | RMP | 0.0 | 0.0 | 0.0 | 0.0 | 0.0 | 0.0 | 0.0 | 0.0 |
| ETHYL VANILLIN 10% DPG | RMP | 0.0 | 0.0 | 0.0 | 0.5 | 0.0 | 0.0 | 0.0 | 0.0 |
| ETHYLENE BRASSYLATE | HMR | 8.0 | 0.0 | 0.0 | 7.0 | 0.0 | 16.0 | 3.0 | 7 |
| EUGENOL | HMI | 0.0 | 0.0 | 0.1 | 0.0 | 0.0 | 0.0 | 0.2 | 0.0 |
| EUGENYL ACETATE | N/A | 0.0 | 0.0 | 0.0 | 0.0 | 0.0 | 0.0 | 0.0 | 0.0 |
| EXALTENONE (TM) (F) | N/A | 0.0 | 0.0 | 0.0 | 0.0 | 0.0 | 0.0 | 0.0 | 0.0 |
| FIR BALSAM OIL | IMP | 0.0 | 0.0 | 0.4 | 0.0 | 0.0 | 0.0 | 0.0 | 0.0 |
| FIR NEEDLE SIBERIA OIL | IMP | 0.0 | 0.0 | 2.0 | 0.0 | 0.0 | 0.0 | 0.0 | 0.0 |
| FLORALOZONE (IFF) | IMP | 0.0 | 0.0 | 2.0 | 0.5 | 0.0 | 0.0 | 0.0 | 0.0 |
| FLORALOZONE (IFF) 10% DPG | IMP | 0.0 | 0.0 | 0.0 | 0.0 | 0.0 | 0.0 | 0.2 | 0.0 |
| FLORHYDRAL (G) | N/A | 0.0 | 0.0 | 0.0 | 0.0 | 0.0 | 0.0 | 0.0 | 0.0 |
| FLOROSA (TM) (Q) | HMR | 0.0 | 0.0 | 0.0 | 0.0 | 0.0 | 0.0 | 0.0 | 0.0 |
| GALAXOLIDE (TM) (IFF) | N/A | 0.0 | 0.0 | 0.0 | 0.0 | 10.0 | 0.0 | 0.0 | 0.0 |
| GALBANUM ARTESSENCE (BIO) 1% DPG | N/A | 0.0 | 0.0 | 0.0 | 0.0 | 0.0 | 0.0 | 0.5 | 0.0 |
| GERANIOL | HMR | 0.0 | 0.0 | 0.0 | 0.4 | 3.0 | 0.0 | 0.0 | 3 |
| GERANIUM AFRICAN OIL | HMR | 0.0 | 0.0 | 0.0 | 0.0 | 0.0 | 0.0 | 0.1 | 0.0 |
| GERANYL ACETATE | N/A | 0.0 | 0.0 | 0.3 | 0.3 | 0.0 | 0.0 | 0.0 | 0.0 |
| GINGER PURE | IMP | 0.0 | 0.0 | 0.4 | 0.0 | 0.0 | 0.0 | 0.0 | 0.0 |
| GRAPEFRUIT BASE | N/A | 0.0 | 0.0 | 0.0 | 0.1 | 0.0 | 0.0 | 0.0 | 0.0 |
| GUAIACWOOD | IMP | 0.0 | 0.0 | 0.0 | 0.4 | 0.0 | 0.0 | 0.0 | 0.0 |
| HABANOLIDE (TM) (F) | RMP | 0.0 | 0.0 | 0.0 | 2.0 | 0.0 | 0.0 | 2.0 | 2 |
| HELIONAL (TM) (IFF) | HMI | 3.0 | 2.0 | 3.0 | 2.0 | 3.0 | 0.0 | 3.0 | 0.0 |
| HELIOTROPIN | N/A | 0.0 | 0.0 | 0.0 | 0.0 | 0.0 | 1.0 | 0.0 | 3 |
| HEXYL ACETATE | HMP | 0.0 | 0.0 | 0.0 | 0.0 | 0.0 | 0.0 | 0.0 | 0.0 |
| HEXYL CINNAMIC ALDEHYDE | GEN | 0.0 | 3.0 | 0.0 | 0.0 | 0.0 | 0.0 | 5.0 | 4 |
| HEXYL SALICYLATE | RMP | 0.0 | 0.0 | 0.0 | 0.0 | 0.0 | 0.0 | 0.0 | 0.0 |
| HYDROXYCITRONELLAL | RMP | 0.0 | 0.0 | 0.0 | 0.0 | 2.5 | 0.0 | 0.0 | 0.0 |
| INDOLE 1% DPG | N/A | 0.0 | 0.0 | 0.0 | 0.0 | 0.5 | 0.0 | 0.0 | 0.0 |
| INDOLE 10% DPG | N/A | 0.0 | 0.0 | 0.0 | 0.0 | 0.0 | 0.0 | 0.0 | 0.0 |
| IONOL (preservative) | N/A | 0.0 | 0.0 | 0.0 | 0.2 | 0.2 | 0.0 | 0.2 | 0.0 |
| IONONE ALPHA | N/A | 0.0 | 0.0 | 0.0 | 0.0 | 0.0 | 0.0 | 0.0 | 0.0 |
| IONONE BETA | GEN | 0.0 | 0.0 | 0.0 | 2.9 | 0.0 | 0.0 | 0.8 | 0.0 |
| IONONE BETA 10% DPG | GEN | 0.0 | 0.0 | 0.0 | 0.0 | 0.4 | 0.0 | 0.0 | 0.0 |
| IRONE ALPHA (TM) (G) 10% DPG | N/A | 0.0 | 0.0 | 0.0 | 0.0 | 0.0 | 0.0 | 0.0 | 0.0 |
| ISOAMBOIS (Q) | GEN | 4.0 | 7.0 | 5.0 | 7.0 | 0.0 | 0.0 | 0.0 | 0.0 |
| ISOAMYL ACETATE 10% DPG | N/A | 0.0 | 0.0 | 0.0 | 0.0 | 0.0 | 0.0 | 0.2 | 0.0 |
| ISOBUTYL ISOBUTYRATE 1% DPG | N/A | 0.0 | 0.0 | 0.0 | 0.0 | 0.0 | 0.0 | 0.0 | 0.0 |
| ISOEUGENOL | HMR | 0.0 | 0.0 | 0.0 | 0.0 | 0.1 | 0.0 | 0.0 | 0.0 |
| ISOEUGENOL 10% DPG | HMR | 0.0 | 0.0 | 0.0 | 0.0 | 0.0 | 0.0 | 0.5 | 0.0 |
| JADENOL (TM) (Q) | HMP | 0.0 | 0.0 | 0.0 | 0.0 | 4.0 | 0.0 | 0.0 | 0.0 |
| JASMIN OIL | RMP | 0.0 | 0.0 | 0.0 | 0.0 | 0.0 | 0.0 | 0.2 | 2 |
| JASMOLACTONE (F) | N/A | 0.0 | 0.0 | 0.0 | 0.0 | 0.1 | 0.0 | 0.0 | 0.0 |
| JASMOPYRANE (Q) | N/A | 0.0 | 0.0 | 0.0 | 0.0 | 0.0 | 0.0 | 0.0 | 0.0 |
| LAVANDIN ABRIALIS OIL | N/A | 0.0 | 0.0 | 1.5 | 0.0 | 0.0 | 0.0 | 0.0 | 0.0 |
| LAVENDER OIL | N/A | 0.0 | 0.0 | 0.0 | 0.7 | 0.0 | 18.0 | 0.0 | 1 |
| LEMON ITALIAN OIL | HMR | 0.0 | 0.0 | 0.0 | 0.0 | 0.0 | 0.0 | 5.0 | 0.0 |
| LIGUSTRAL (Q) | HMI | 0.0 | 0.1 | 0.0 | 0.0 | 0.2 | 0.0 | 0.0 | 0.0 |
| LIGUSTRAL (Q) 10% DPG | HMI | 4.0 | 0.0 | 3.0 | 0.5 | 0.0 | 0.0 | 2.0 | 0.0 |
| LILY ALDEHYDE | GEN | 6.0 | 5.0 | 0.0 | 1.3 | 20.0 | 0.0 | 14.0 | 4 |

TABLE 1-continued

Fragrance compositions

| INGREDIENT | GROUP | FRAGRANCE COMPOSITIONS I1 w/w % | I2 w/w % | I3 w/w % | I4 w/w % | C1 w/w % | C2 w/w % | C3 w/w % | C4 w/w % |
|---|---|---|---|---|---|---|---|---|---|
| LIME OIL | N/A | 0.0 | 0.0 | 0.0 | 0.0 | 0.4 | 0.0 | 0.0 | 0.0 |
| LINALOL | GEN | 0.0 | 3.0 | 2.6 | 4.0 | 5.5 | 0.0 | 1.0 | 6 |
| LINALYL ACETATE | IMP | 0.0 | 0.0 | 8.5 | 5.3 | 0.0 | 0.0 | 0.0 | 0.0 |
| *LITSEA CUBEBA* OIL | IMP | 1.0 | 0.4 | 0.0 | 0.1 | 0.0 | 0.0 | 0.0 | 0.0 |
| LYRAL | HMR | 0.0 | 0.0 | 1.3 | 0.0 | 0.0 | 5.0 | 2.0 | 3 |
| MANDARIN ITALIAN OIL | HMI | 4.0 | 3.0 | 0.0 | 1.5 | 0.0 | 0.0 | 0.4 | 0.0 |
| MANDARIN ITALIAN OIL 10% DPG | HMI | 4.0 | 0.0 | 0.0 | 0.0 | 0.0 | 0.0 | 0.0 | 0.0 |
| MANZANATE (Q) 10% DPG | N/A | 0.0 | 0.0 | 0.0 | 0.0 | 0.1 | 0.0 | 0.0 | 0.0 |
| MEFROSOL (Q) | RMP | 0.0 | 0.0 | 0.0 | 0.0 | 0.0 | 0.0 | 0.0 | 0.0 |
| MELONAL (TM) (G) | N/A | 0.0 | 0.0 | 0.0 | 0.0 | 0.2 | 0.0 | 0.2 | 0.0 |
| METHYL ANTHRANILATE | N/A | 0.0 | 0.4 | 0.0 | 0.0 | 0.0 | 0.0 | 0.0 | 0.0 |
| METHYL BUTANOL 1,2 10% DPG | N/A | 0.0 | 0.0 | 0.0 | 0.0 | 0.2 | 0.0 | 0.0 | 0.0 |
| METHYL CHAVICOL 10% DPG | N/A | 0.0 | 0.0 | 0.0 | 0.0 | 0.5 | 0.0 | 0.0 | 0.0 |
| METHYL DIHYDROJASMONATE | GEN | 36.0 | 42.0 | 0.0 | 9.0 | 15.0 | 10.0 | 20.0 | 0.0 |
| METHYL HEPTENONE 10% DPG | N/A | 0.0 | 0.0 | 0.0 | 0.0 | 0.3 | 0.0 | 0.0 | 0.0 |
| METHYL HEPTINE CARBONATE 10% DPG | N/A | 0.0 | 0.0 | 0.0 | 0.0 | 0.4 | 0.0 | 0.0 | 0.0 |
| METHYL IONONE ALPHA ISO | HMR | 0.0 | 0.0 | 0.0 | 0.0 | 4.0 | 12.0 | 1.0 | 2 |
| METHYL OCTINE CARBONATE 20 10% DPG | N/A | 0.0 | 0.0 | 0.0 | 0.0 | 0.0 | 0.0 | 0.7 | 0.0 |
| METHYL PAMPLEMOUSSE (G) | HMP | 0.0 | 0.0 | 0.0 | 0.0 | 0.0 | 0.0 | 0.0 | 0.0 |
| MOSS OAKMOSS SYNTHETIC | IMP | 0.0 | 0.0 | 1.8 | 0.0 | 0.0 | 0.0 | 0.0 | 0.8 |
| MOSS OAKMOSS SYNTHETIC 10% DPG | IMP | 2.0 | 0.0 | 0.0 | 0.5 | 0.2 | 3.0 | 0.0 | 0.0 |
| MUGUET MAYCIANE OIL | N/A | 0.0 | 0.0 | 0.0 | 0.0 | 0.0 | 0.0 | 6.0 | 0.0 |
| MUSCENONE (TM) (F) | HMR | 0.0 | 0.0 | 0.0 | 0.0 | 0.0 | 0.0 | 0.0 | 0.0 |
| NEROLI OIL | N/A | 0.0 | 0.0 | 0.0 | 0.0 | 0.0 | 0.0 | 0.0 | 0.0 |
| NONALACTONE GAMMA | N/A | 0.0 | 0.0 | 0.0 | 0.0 | 0.0 | 0.0 | 0.0 | 0.0 |
| NONALACTONE GAMMA 10% DPG | N/A | 0.0 | 0.0 | 0.0 | 0.0 | 0.0 | 0.0 | 0.7 | 0.0 |
| NUTMEG | IMP | 0.0 | 0.0 | 2.5 | 1.0 | 0.0 | 0.0 | 0.0 | 0.0 |
| OLIBANUM RESINOID | IMP | 2.0 | 0.2 | 1.0 | 0.0 | 0.0 | 3.0 | 0.0 | 0.0 |
| ORANGE BRAZIL PURE | HMI | 0.0 | 0.0 | 3.0 | 10.0 | 0.0 | 0.0 | 1.0 | 0.0 |
| ORANGE FLORIDA LIGHT OIL | HMI | 3.0 | 0.0 | 0.0 | 0.0 | 0.0 | 0.0 | 0.0 | 0.0 |
| ORANGE FLOWER BASE | IMP | 0.0 | 0.0 | 0.0 | 0.6 | 0.0 | 0.0 | 0.0 | 0.0 |
| ORTHOLATE (TM) (Q) | HMI | 0.0 | 0.0 | 2.0 | 0.0 | 0.5 | 0.0 | 0.0 | 0.0 |
| OXANE (TM) (F) 1% DPG | N/A | 0.0 | 0.0 | 0.0 | 0.0 | 0.5 | 0.0 | 0.0 | 0.0 |
| OZONAL AB 7203C (TM) | IMP | 0.0 | 0.4 | 2.0 | 0.0 | 0.0 | 0.0 | 0.0 | 0.0 |
| PASSION FRUIT 109223 (F) | N/A | 0.0 | 0.7 | 0.0 | 0.0 | 0.0 | 0.0 | 0.0 | 0.0 |
| PATCHOULI LIGHT OIL | IMP | 0.0 | 0.0 | 0.0 | 0.0 | 0.0 | 3.0 | 0.0 | 0.0 |
| PATCHOULI OIL | IMP | 0.0 | 0.0 | 5.0 | 0.0 | 0.0 | 0.0 | 0.0 | 7.0 |
| PEPPER BLACK P315 (TM) (BIO) | N/A | 0.0 | 0.0 | 0.0 | 0.0 | 0.0 | 0.0 | 0.0 | 0.0 |
| PEPPERCORN PINK | N/A | 0.0 | 0.0 | 0.0 | 0.0 | 0.0 | 0.0 | 0.0 | 0.0 |
| PEPPERCORN PINK 10% DPG | N/A | 0.0 | 0.0 | 0.0 | 0.0 | 0.0 | 0.0 | 0.0 | 0.0 |
| PHENYL ACETALDEHYDE DIMETHYL ACETAL | N/A | 0.0 | 0.0 | 0.0 | 0.0 | 0.0 | 0.0 | 0.0 | 0.0 |
| PHENYL ETHYL ALCOHOL | GEN | 0.0 | 5.0 | 0.0 | 1.7 | 1.0 | 0.0 | 3.3 | 13.5 |
| PRUNELLA (TM) (F) | RMP | 0.0 | 0.0 | 0.0 | 0.0 | 0.0 | 6.0 | 0.0 | 0.0 |
| RASPBERRY KETONE | HMP | 0.0 | 0.0 | 0.0 | 0.0 | 0.0 | 0.0 | 0.0 | 0.0 |
| ROSE OIL | N/A | 0.0 | 0.0 | 0.0 | 0.0 | 0.0 | 0.0 | 0.0 | 1.0 |
| ROSE OXIDE LAEVO 10% DPG | IMP | 0.0 | 0.0 | 0.5 | 0.0 | 0.0 | 0.0 | 0.0 | 0.0 |
| ROSEMARY FRENCH OIL | IMP | 0.0 | 0.0 | 2.4 | 0.0 | 0.0 | 0.0 | 0.0 | 0.0 |
| ROSEWOOD | N/A | 0.0 | 0.0 | 0.0 | 3.0 | 0.0 | 0.0 | 0.0 | 0.0 |
| SAGE CLARY OIL | IMP | 0.0 | 0.0 | 0.9 | 0.0 | 0.0 | 0.0 | 0.0 | 0.0 |
| SANDELA GD (TM) (G) | GEN | 0.0 | 0.0 | 2.0 | 0.8 | 0.0 | 0.0 | 0.0 | 0.0 |
| SILVANONE (TM) (Q) | HMR | 0.0 | 0.0 | 0.0 | 0.0 | 0.0 | 4.0 | 0.0 | 0.0 |
| SPEARMINT OIL | IMP | 0.0 | 0.0 | 0.2 | 0.0 | 0.0 | 0.0 | 0.0 | 0.2 |
| STYRALLYL ACETATE | HMP | 0.0 | 0.0 | 0.0 | 0.0 | 0.0 | 0.0 | 0.3 | 0.0 |
| STYRALLYL ACETATE 10% DPG | HMP | 0.0 | 0.0 | 0.0 | 0.0 | 0.0 | 0.0 | 0.0 | 0.0 |
| TAGETES EGYPTIAN OIL | N/A | 0.0 | 0.0 | 0.0 | 0.0 | 0.0 | 0.0 | 0.0 | 0.0 |
| TAMARINE AB 8212E (TM) | IMP | 0.0 | 0.0 | 0.0 | 0.2 | 0.0 | 0.0 | 0.0 | 0.0 |
| TARRAGON OIL | IMP | 0.0 | 0.0 | 0.4 | 0.0 | 0.0 | 0.0 | 0.0 | 0.0 |
| TERPINEOL | RMP | 0.0 | 0.0 | 0.0 | 0.0 | 0.0 | 0.0 | 1.2 | 0.0 |
| THYME WHITE OIL10% DPG | N/A | 0.0 | 0.0 | 0.0 | 0.0 | 0.0 | 0.0 | 0.0 | 0.0 |
| TONALID | N/A | 0.0 | 0.0 | 0.0 | 0.0 | 4.5 | 0.0 | 0.0 | 0.0 |
| TOP ROSE BASE | N/A | 0.0 | 0.0 | 0.0 | 0.0 | 0.2 | 0.0 | 0.0 | 0.0 |
| TRANS-2-CIS-6-NONADIENAL 0.1% DPG | N/A | 0.0 | 1.0 | 0.0 | 0.0 | 0.0 | 0.0 | 0.0 | 0.0 |
| TUBEROSE BASE | N/A | 0.0 | 0.0 | 0.0 | 0.0 | 0.0 | 0.0 | 0.6 | 1.0 |
| UNDECALACTONE GAMMA | HMR | 0.0 | 0.0 | 0.0 | 0.0 | 0.0 | 0.0 | 0.0 | 0.0 |
| UNDECAVERTOL (G) | HMP | 0.0 | 0.0 | 0.0 | 0.0 | 0.0 | 0.0 | 0.2 | 0.0 |
| VANILLIN | RMP | 0.0 | 0.0 | 0.0 | 0.0 | 0.0 | 3.0 | 0.0 | 1.0 |
| VANILLIN 10% DPG | RMP | 0.0 | 0.0 | 0.0 | 0.0 | 0.0 | 0.0 | 0.0 | 0.0 |
| VELOUTONE (F) | HMP | 0.0 | 0.0 | 0.0 | 0.0 | 0.0 | 0.0 | 0.0 | 0.0 |

TABLE 1-continued

Fragrance compositions

| INGREDIENT | GROUP | FRAGRANCE COMPOSITIONS I1 w/w % | I2 w/w % | I3 w/w % | I4 w/w % | C1 w/w % | C2 w/w % | C3 w/w % | C4 w/w % |
|---|---|---|---|---|---|---|---|---|---|
| VERTOFIX COEUR (TM) (IFF) | HMP | 0.0 | 0.0 | 0.0 | 0.0 | 0.0 | 0.0 | 0.0 | 6.0 |
| VETYVERYL ACETATE | N/A | 0.0 | 0.0 | 0.0 | 0.0 | 0.0 | 0.0 | 0.0 | 1.0 |
| YLANG OIL | HMP | 0.0 | 0.0 | 0.0 | 0.0 | 0.0 | 0.0 | 0.9 | 0.8 |
| TOTAL % | | 100 | 100 | 100 | 100 | 100 | 100 | 100 | 100 |

Key to suppliers:
B = Biolandes
F = Firmenich
G = Givaudan
IFF = International Flavors and Fragrances
Q = Quest International
Notes:
1) "Ingredient Y X % DPG" indicates X % of ingredient Y in a DPG solution
2) "N/A" indicates a material that is not allocated (i.e. the group is unknown)
3) "SOLV" indicates the material to be a solvent

TABLE 2

Group Analysis of Fragrances of Table

| SUM % | FRAGRANCE COMPOSITIONS I1 | I2 | I3 | I4 | C2 | C3 | C4 | C7 |
|---|---|---|---|---|---|---|---|---|
| HMRs | 8.0 | 3.0 | 1.3 | 7.6 | 8.9 | 37.0 | 15.3 | 20.5 |
| HMIs | 11.0 | 5.1 | 15.7 | 20.6 | 4.7 | 3.0 | 6.0 | 0.0 |
| GEN | 46.0 | 65.0 | 9.6 | 28.7 | 41.5 | 10.0 | 45.6 | 28.5 |
| IMPs | 21.2 | 9.0 | 56.6 | 26.5 | 1.3 | 9.3 | 4.1 | 8.0 |
| HMPs | 3.0 | 5.0 | 0.2 | 0.0 | 8.8 | 0.0 | 4.6 | 6.8 |
| RMPs | 0.0 | 1.0 | 0.5 | 2.7 | 3.0 | 14.0 | 3.9 | 10.2 |
| TOTAL | 89.2 | 88.1 | 83.9 | 85.9 | 68.2 | 73.3 | 79.5 | 74.0 |
| SOLV | 10.8 | 10.8 | 11.5 | 9.1 | 15.9 | 6.5 | 11.8 | 7.6 |
| ratio 1 | 0.80 | 0.78 | 0.98 | 0.82 | 0.34 | 0.19 | 0.35 | 0.21 |
| ratio 2 | 0.88 | 0.60 | 0.99 | 0.91 | 0.10 | 0.40 | 0.33 | 0.32 |
| ratio 3 | 0.61 | 0.33 | 0.77 | 0.61 | 0.03 | 0.19 | 0.12 | 0.16 |
| Sums corrected for solvent | | | | | | | | |
| solvent correction* | 1.1 | 1.1 | 1.1 | 1.1 | 1.2 | 1.1 | 1.1 | 1.1 |
| HMRs | 9.0 | 3.4 | 1.5 | 8.3 | 10.6 | 39.6 | 17.3 | 22.2 |
| HMIs | 12.3 | 5.7 | 17.8 | 22.6 | 5.6 | 3.2 | 6.8 | 0.0 |
| GEN | 51.6 | 72.9 | 10.8 | 31.6 | 49.4 | 10.7 | 51.7 | 30.8 |
| IMPs | 23.8 | 10.1 | 63.9 | 29.1 | 1.5 | 9.9 | 4.7 | 8.7 |
| HMPs | 3.4 | 5.6 | 0.2 | 0.0 | 10.4 | 0.0 | 5.2 | 7.4 |
| RMPs | 0.0 | 1.1 | 0.6 | 2.9 | 3.6 | 15.0 | 4.4 | 11.0 |
| TOTAL | 100.0 | 98.8 | 94.8 | 94.5 | 81.1 | 78.4 | 90.1 | 80.1 |
| condition 1 | Y | Y | Y | Y | no | no | no | no |
| condition 2 | YES | YES | YES | YES | no | no | no | no |

Notes:
*Solvent correction obtained as 100/(100 − SOLV)
ratio 1 = (IMPs + HMIs)/(IMPs + HMIs + RMPs + HMRs)
ratio 2 = IMPs/(IMPs + HMPs + RMPs)
ratio 3 = IMPs/[(IMPs + HMPs + RMPs) + (100 − TOTAL)]
condition 1 is IMPs >= HMPs + HMRs
condition 2 is IMPs + HMIs + GENs >= 70%

EXAMPLE 3

Salivary cortisol provides a convenient route to assess the degree of stress throughout the day. In the below protocol two perfumes were subjected to a cortisol test largely based on that disclosed in WO 2002/049629. The perfume of the invention I3, with an aromatic fougere scent and perceived as invigorating, was found not to promote higher cortisol levels during a working day than did a control procedure excluding perfume. A comparative perfume C4, a spicy oriental type perceived as relaxing, was found to produce a significantly higher level of cortisol depression, as expected.

Protocol:

A group of healthy subjects (3 male and 2 female, known as subjects A to E) participated in trials over several days to assess the relaxation/invigorating effect of smelling two fragrances as indicated by changes in salivary cortisol levels. Assessments took place at least 4 hours after waking each day.

1) Initial saliva sample provided (approx 1 ml)
2) Smelling of fragrance (randomised across days) for 15 minutes i.e. smelling from fragranced sorborod for 20 seconds every 2 minutes.
3) Second saliva sample provided 30 minutes after the end of the smelling.
4) Sample stored in refrigerator until completion of all days experimentation.
5) All samples were analysed using an ELISA kit sourced from Immunodiagnostic Systems Limited (code SLV-2930).

Results:

The effect of no treatment was a small (ca 4.5%) depression in cortisol. Smelling perfume I3 produced a slightly larger depression (ca 8%) but identical within experimental error. The relaxing fragrance yielded a significantly larger cortisol depression (ca. 28%). Fragrance I3 is therefore invigorating without causing noticeable increases in cortisol production.

TABLE 3

Effect of smelling fragrance I3 on salivary cortisol levels

| | Control | | I3 | | % Change | |
|---|---|---|---|---|---|---|
| | Start | End | Start | End | Control | I3 |
| A | 6.48 | 6.53 | 5.20 | 4.57 | 0.751 | −12.057 |
| B | 4.20 | 4.50 | 6.08 | 5.11 | 7.089 | −15.916 |
| C | 3.37 | 3.12 | 3.83 | 3.36 | −7.252 | −12.311 |
| D | 3.97 | 3.80 | 4.12 | 4.43 | −4.369 | 7.472 |
| E | 3.44 | 2.81 | 3.46 | 3.21 | −18.477 | −7.079 |
| Mean | 4.29 | 4.15 | 4.37 | 4.03 | −4.452 | −7.978 |
| StDev | 1.27 | 1.48 | 1.17 | 0.90 | 9.55 | 9.19 |

TABLE 4

| Effect of smelling fragrance C4 on salivary cortisol levels | | | | | | |
|---|---|---|---|---|---|---|
| | Control | | C4 | | % Change | |
| | Start | End | Start | End | Control | C4 |
| A | 6.48 | 6.53 | 5.25 | 3.44 | 0.751 | −34.504 |
| B | 4.20 | 4.50 | 5.57 | 3.88 | 7.089 | −30.265 |
| C | 3.37 | 3.12 | 4.17 | 3.40 | −7.252 | −18.532 |
| D | 3.97 | 3.80 | 3.99 | 3.11 | −4.369 | −22.146 |
| E | 3.44 | 2.81 | 3.58 | 2.43 | −18.477 | −32.251 |
| Mean | 4.29 | 4.15 | 4.33 | 3.21 | −4.452 | −27.540 |
| StDev | 1.27 | 1.48 | 0.86 | 0.61 | 9.55 | 6.86 |

EXAMPLE 4

The fragrances of Table 1 were subjected to two protocols designed to yield information on the mood response they engender.

A) Mood Attribute Testing (MAT)

This was a central location sniff test carried out in the UK.

150 naïve consumers were either pre-recruited or recruited by intercept in the street to attend a hall test. They were pre-screened for any nasal disorders or allergic sensitivities to smelling fragrance. The panellists were all female and were selected to represent a cross section of ages from 18 to 55 and a cross section of social classes.

Each subject was asked to smell the fragrances in a predetermined order. As each fragrance was smelt they were asked to mark a series of given mood scales according to how the fragrance made them feel (e.g. comforted, safe, soothed). There were 24 mood scales in all and each was scored on a 0-10 scale from "not at all" to "extremely".

B) Mood Portraits

This was also a central location sniff test carried out in the UK, and as for the Mood Attribute Scaling 150 naïve consumers were either pre-recruited or recruited by intercept in the street to attend a hall test. They were pre-screened for any nasal disorders or allergic sensitivities to smelling fragrance. The panellists used were all female and were selected to represent a cross section of ages from 18 to 55 and a cross section of social classes.

Each subject was asked to smell the fragrances in a predetermined order. For this test they were asked to experience the mood or emotion evoked by the fragrance and then select, from a library of displayed pictures, up to 5 that evoke the same or similar mood or emotion. Research carried out previously at Quest had established the mood or emotions evoked by the pictures and had also developed a statistical approach to transforming the picture selection frequency data into mood profiles for each fragrance.

The rank orders from each test are shown below in table 5, with the most invigorating fragrance being ranked as '1'. Although there is noise in the data the subset of invigorating fragrances according to the present invention is clearly discriminated from the comparative fragrances.

TABLE 5

| | Rank Order for 'Stimulating' | |
|---|---|---|
| Perfume Code | MAT Method | |
| I1 | 3 | 2 |
| I2 | 4 | 3 |
| I3 | 2 | 1 |
| I4 | 1 | 4 |

TABLE 5-continued

| | Rank Order for 'Stimulating' | |
|---|---|---|
| Perfume Code | MAT Method | |
| C1 | 5 | 6 |
| C2 | 8 | 8 |
| C3 | 6 | 5 |
| C4 | 7 | 7 |

The invention claimed is:

1. A fragrance composition comprising at least 40 perfume ingredients present in an amount of at least 75% by weight, wherein the ingredients are selected from the following groups:

A) at least 15% by weight in total of at least three ingredients are selected from Group 'IMP', wherein Group 'IMP' comprises: allyl amyl glycolate; benzyl salicylate; bergamot oil; coriander oil; cyclamen aldehyde; 1-(2,6,10-trimethylcyclododeca-2,5,9-trien-1-yl) ethanone; prop-2-enyl (cyclohexyloxy)acetate; Damascenia 185 SAE; 2,4-dimethylheptan-1-ol; fir balsam; fir needle oil; 3-(4-ethylphenyl)-2,2-dimethylpropanal; ginger oil; guaiacwood; linalyl acetate; litsea cubeba oil; methyl 2,4-dihydroxy-3,6-dimethylbenzoate; nutmeg oil; olibanum oil; orange flower oil; Ozonal AB 7203C; patchouli oil; rose oxide; rosemary oil; sage clary oil; spearmint oil; Tamarine AB 8212E; and tarragon oil;

B) optionally up to 90% by weight of the ingredients are selected from the following groups:

Group 'HMR' comprising:

allyl ionone; benzyl acetate; cis-jasmone; citronellol; ethyl linalol; ethylene brassylate; 4-methyl-2-(2-methylpropyl)tetrahydro-2H-pyran-4-ol; geraniol; geranium oil; iso-eugenol; lemon oil; 3-(4-hydroxy-4-methylpentyl)cyclohex-3-ene-1-carbaldehyde; 4-(4-hydroxy-4-methylpentyl)cyclohex-3-ene-1-carbaldehyde; alpha-iso-methyl ionone; 3-methylcyclopentadec-2-en-1-one; cyclopentadecanone; cyclohexadecanolide; and gamma-undecalactone;

Group 'HMI' comprising:

1-{[2-(1,1-dimethylethyl)cyclohexyl]oxy}butan-2-ol; 3a,6,6,9a-tetramethyldodecahydronaphtho[2,1-{b}] furan; alpha-damascone; dihydromyrcenol; eugenol; 3-(1,3-benzodioxol-5-yl)-2-methylpropanal; 2,4-dimethylcyclohex-3-ene-1-carbaldehyde; mandarin oil; orange oil; and 2-(1,1-dimethylethyl)cyclohexyl acetate;

Group 'HMP' comprising:

1-(2,6,6,8-tetramethyltricyclo [5.3.1.0{1,5}]undec-8-en-9-yl)ethanone; allyl cyclohexylpropionate; allyl heptanoate; Apple Oliffac S pcmf; 7-methyl-2H-1,5-benzodioxepin-3(4H)-one; cassis base; cis-3-hexenyl salicylate; damascenone; gamma-decalactone; ethyl acetoacetate; ethyl maltol; ethyl methyl phenylglycidate; hexyl acetate; (3E)-4-methyldec-3-en-5-ol; 2,5,5-trimethyl-6,6-bis(methyloxy)hex-2-ene; 4-(4-hydroxyphenyl)butan-2-one; styrallyl acetate; 2,2,5-trimethyl-5-pentylcyclopentanone; and ylang oil;

Group 'RMP' comprising:

anisic aldehyde; (2Z)-2-ethyl-4-(2,2,3-trimethylcyclopent-3-en-1-yl)but-2-en-1-ol; benzoin siam resinoid; ethyl vanillin; oxacyclohexadec-12(13)-en-2-one; hexyl salicylate; hydroxycitronellal; jasmin oil;

3-methyl-5-phenylpentan-1-ol; 2-(phenyloxy)ethyl 2-methylpropanoate; alpha-terpineol; and vanillin; and Group 'GEN' comprising:

cyclopentadecanolide; hexyl cinnamic aldehyde; ionone beta; isobornyl cyclohexanol; 1-(2,3,8,8-tetramethyl-1,2,3,4,5,6,7(8),8(8a)-octahydronaphthalen-2-yl)ethanone; 3-[4-(1,1-dimethylethyl)phenyl]-2-methylpropanal; linalol; methyl dihydrojasmonate; and 2-phenylethanol;

provided the following conditions (a) through (e) are met:

(a) IMPs >=HMPs +HMRs;

(b) IMPs +HMIs +GENs >=70%;

(c) (IMP +HMI)/(IMP +HMI +RMP +HMR)>=0.7;

(d) IMPs/(HMPs+RMPs+IMPs) >=0.5; and (e) IMPs/[(HMPs+RMPs+IMPs) +(100-TOTAL)] >=0.3, wherein 'IMPs' indicates the sum of the percentages of the ingredients within Group IMP, and similarly for the remaining groups, the symbol '>=' indicates 'at least equal to', and 'TOTAL' is the sum of HMPs, HMRs, HMIs, IMPs, RMPs and GENs, provided also that solvents scoring less than 80on an odour index scale based on a comparison with the odour intensity of a control sample of a 10% solution of benzyl acetate in dipropylene glycol, which corresponds to an index of 100 are excluded from the calculation of these sums.

2. A fragrance composition according to claim 1, where at least 80% by weight of the ingredients are from the total of Groups IMP, HMI and GEN.

3. A fragrance composition according to claim 1, wherein the ratio of IMPs/(HMPs +RMPs +IMPs) is at least 0.6.

4. A fragrance composition according to claim 1, where at least five of the ingredients are from Group IMP.

5. A fragrance composition according to claim 4, where at least eight of the ingredients are from Group IMP.

6. A fragrance composition according to claim 1, where at least 90% by weight of the ingredients are from the total of Groups IMP, HMI and GEN.

7. A consumer composition comprising a fragrance composition according to claim 1.

8. A method of providing activated, pleasant moods through inhalation of an effective amount of a fragrance composition according to claim 1.

9. A process of dispensing a fragrance composition according to claim 1 in an amount and for a time sufficient to provide effective vaporous emission for inhalation by a subject.

10. A fragrance composition according to claim 1, comprising at least two ingredients from the GEN group.

11. A fragrance composition according to claim 10, wherein the at least two ingredients are linalol and 3-[4-(1,1-dimethylethyl)phenyl]-2-methylpropanal.

12. A fragrance composition according to claim 1, comprising at least one ingredient from the HMI group.

13. A fragrance composition according to claim 1, wherein one of the at least three ingredients present from the IMP group is methyl 2,4-dihydroxy-3,6-dimethylbenzoate.

14. A fragrance composition according to claim 1, wherein one of the at least three ingredients present from the IMP group is linalyl acetate.

15. A fragrance composition according to claim 1, comprising at least one ingredient from the RMP group.

16. A fragrance composition according to claim 15, wherein the at least one ingredient from the RMP group is alpha-terpineol.

17. A fragrance composition according to claim 1, comprising at least two ingredients from the GEN group and at least one ingredient from the HMI group.

18. A fragrance composition according to claim 17, further comprising at least one ingredient from the RMP group.

* * * * *